US005454121A

United States Patent [19]

Mellinger

[11] Patent Number: 5,454,121

[45] Date of Patent: Oct. 3, 1995

[54] RING SHAPED SCARF, BOW AND CLIP COMBINATION

[76] Inventor: Orvetta G. Mellinger, 12887 W. Peacock, Zion, Ill. 60099

[21] Appl. No.: 198,523

[22] Filed: Feb. 17, 1994

[51] Int. Cl.[6] ..... A41D 23/00; A42B 5/00

[52] U.S. Cl. ..... 2/207; 63/20; 132/279

[58] Field of Search ..... 2/207, 244, 279; 63/20, 14.1, 14.4, 14.8; 132/278, 279; 223/46; D2/500, 501, 853, 605, 608

[56] References Cited

U.S. PATENT DOCUMENTS

| | | | |
|---|---|---|---|
| D. 92,603 | 7/1934 | James | 2/207 X |
| 1,582,558 | 4/1926 | Taylor . | |
| 2,050,804 | 8/1936 | Philippe | 63/20 |
| 2,806,222 | 9/1957 | Carpenter | 2/207 X |
| 3,260,292 | 7/1966 | Costello | 2/207 X |
| 4,723,325 | 2/1988 | Perry | 2/207 |
| 4,976,277 | 12/1990 | Yasuda | 132/279 |
| 5,144,696 | 9/1992 | Kahl | 2/207 |
| 5,259,405 | 11/1993 | Hua-Chou | 132/279 |

FOREIGN PATENT DOCUMENTS

| | | | |
|---|---|---|---|
| 598208 | 2/1948 | United Kingdom | 63/14 |

*Primary Examiner*—Clifford D. Crowder
*Assistant Examiner*—Shirra L. Jenkins
*Attorney, Agent, or Firm*—Charles F. Meroni, Jr.

[57] ABSTRACT

The present invention relates to an improved fashionable neckwear ensemble for women. More particularly I have provided a method of creating a fashionable scarf and clip ensemble. The clip being of the type having a ring shaped clip portion that is hingedly connected to an ornamental clip portion, with the hinge and ornamental clip portions being relatively movable from closed to open positions. The steps of forming a length of scarf material into a loop, the scarf material having two ends, attaching the ends to each other to form a ring shaped piece of scarf material with a central opening having a sufficient length and diameter to fit over a woman's head and around a woman's neck. Then grasping centrally located inner edges of the ring shaped piece of scarf material and then projecting them through the ring shaped clip portion when the clip is in an open position and pulling the inner edges of the ring shaped piece of scarf material through the ring shaped clip portion and then turning the inner edge portions so as to extend them in opposite directions relative to one another to enlarge the breadth of the scarf thereby creating a flowerlike shape. Then moving the ornamental clip portion on its hinge towards the ring shaped clip portion and against the scarf to clamp and hold the edge portions securely against the ring shaped piece of scarf material, whereby a flowerlike shape is centrally located on the ring shaped piece of scarf material.

8 Claims, 5 Drawing Sheets

RING SHAPED SCARF, BOW AND CLIP COMBINATION

BACKGROUND OF THE INVENTION

The present invention relates in general to woman's wear comprising a new and improved neck-piece. The neck-piece comprises a ring shaped piece of scarf material, a clip and/or a bow. Other neck pieces usually do include the combination of a ring shaped piece of scarf material a clip and/or a bow.

According to my invention I have utilized the elements of my combination in a number of new arrangements to achieve different fashion effects that are not believed to have been used before. In this regard, it will be observed that I have utilized the ring shaped piece of scarf material that has a center opening enabling the head of the wearer to be received. Once the ring shaped piece of scarf material is mounted on a person's neck, then the clip can be utilized in a variety of different to achieve different fashions as hereafter explained and claimed in greater detail.

For many years women have worn their scarves many different ways from tying them around the neck, over the shoulder and strategically pinning them to their blouses to create a fashionable look. In order for a woman to create the fashionable look she wants with her scarf, it may take a lot of time and talent to create the appropriate look. Therefore, it has not been easy for women to create many different fashionable creations with her scarf, thereby limiting the use of the scarf and limiting the type of style that can be created with the scarf.

The object of the present invention is to provide a piece of scarf material intended for ladies' wear that would make it easy for a woman to not only create a stylish scarf, but would also be able to use the same scarf to easily create many different styles. My scarf comprises a ring shaped piece of scarf material, an ornamental clip and/or a bow. The ornamental clip and/or the bow allow the user of the scarf to quickly and easily create many different fashionable scarf combinations. The ornamental clip allows the user to either pinch the scarf material and hold it in a certain position or it allows the user to pull scarf edges through a ring portion of the ornamental clip and then pinching the scarf material in order to create flowerlike shapes and bows. In addition, the ornamental clip also adds a fashionable appearance to the scarf since the ornamental clip can be color coordinated with the scarf. The bow is used to pinch and hold the scarf material in place and the bow adds a stylish look to the scarf especially when the bow matches the scarf.

The ring shaped scarf itself is worn loosely around the woman's neck thereby allowing a sufficient amount of scarf material to be clipped together and/or drawn through a ring of an ornamental clip in order to create a fashionable appearance with the scarf.

SUMMARY OF THE INVENTION

In accordance with my invention I have provided a method of creating a fashionable scarf and a clip ensemble, the clip being of the type having a ring shaped clip portion that is hingedly connected to an ornamental clip portion, with the hinge and ornamental clip portions being relatively movable from closed to open positions, the steps of forming a length of scarf material into a loop, the scarf material having two ends, attaching the ends to each other to form a ring shaped piece of scarf material with a central opening having a sufficient length and diameter to fit over a woman's head and around a woman's neck and then pinching areas of the ring shaped piece of scarf material together with the clip thereby creating a fashionable scarf and clip ensemble.

Other features of my invention provide that one of the arrangements of my fashionable scarf and clip ensemble also includes the steps of grasping centrally located inner edges of the ring shaped piece of scarf material and then projecting them through the ring shaped clip portion when the clip is in an open position and pulling the inner edges of the ring shaped piece of scarf material through the ring shaped clip portion and then turning the inner edge portions so as to extend them in opposite directions relative to one another to enlarge the breadth of the scarf thereby creating a flowerlike shape, and then moving the ornamental clip portion on its hinge towards the ring shaped clip portion and against the scarf to clamp and hold the edge portions securely against the ring shaped piece of scarf material, whereby a flowerlike shape is centrally located on the ring shaped piece of scarf material.

Further features of my invention provide that another arrangement of my fashionable scarf and clip ensemble also includes the steps of grasping inner edges located towards the bottom of the ring shaped piece of scarf material and then projecting them through the ring shaped clip portion when the clip is in an open position and pulling the inner edges of the ring shaped piece of scarf material through the ring shaped clip portion and then pulling the scarf material downwardly away from the hinged area of the clip thereby creating a bow and then moving the ornamental clip portion on its hinge towards the ring shaped clip portion and against the scarf to clamp and hold the edge portions securely against the ring shaped piece of scarf material, whereby the bow is located below the ring shaped piece of scarf material.

Still other features of my invention provide that a further arrangement of my fashionable scarf and clip ensemble also includes the steps of grasping a bottom portion of the ring shaped piece of scarf material and then twisting the scarf material until the ring shaped piece of scarf material is fully twisted and then placing the open clip over the twisted scarf material at the bottom of the scarf and closing the clip about the twisted scarf material to secure the scarf in a twisted fashionable position.

Yet other features of my invention provide that my fashionable scarf and clip ensemble also includes a bow, the bow being of the type having a bow clasp portion that is hingedly connected to an ornamental bow portion, with the bow clasp portions and ornamental bow portions being relatively movable from closed to open positions, the fashionable scarf and clip ensemble also includes the steps of grasping a bottom portion of the ring shaped piece of scarf material and then twisting the scarf material until the ring shaped piece of scarf material is fully twisted and then clasping the bow about the scarf material at a center portion of the scarf thereby securing the scarf material that is positioned around the neck in a twisted look, then untwisting the scarf material below the bow and placing the open clip over the untwisted scarf material at the bottom of the scarf and closing the clip about the untwisted scarf material thereby creating a fashionable scarf, bow and clip ensemble.

Still another feature of my invention relates to the method of creating a fashionable scarf and a bow ensemble, the bow being of the type having a bow clasp portion that is hingedly connected to an ornamental bow portion, with the bow clasp portions and ornamental bow portions being relatively movable from closed to open positions, the steps of forming a length of scarf material into a loop, the scarf material having two ends, attaching the ends to each other to form a ring shaped piece of scarf material with a central opening having a sufficient length and diameter to fit over a woman's head and around a woman's neck, overlapping the ring shaped piece of scarf material and grasping a piece of scarf material centrally located on the scarf and then centrally clasping the bow about the scarf over the edges of the scarf material and spreading out the lower portion of the ring shaped piece of scarf material thereby creating a fashionable scarf and bow combination.

DESCRIPTION OF THE PREFERRED EMBODIMENT

Figure 1:
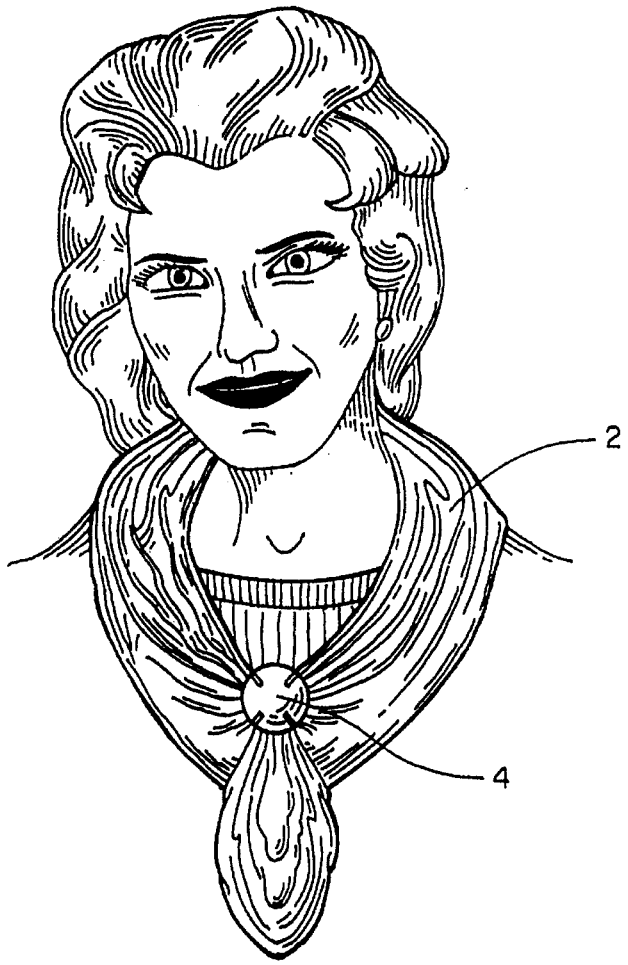
FIG. 1 is a perspective view of how my ring shaped scarf and clip combination is worn on a woman.
Figure 2:
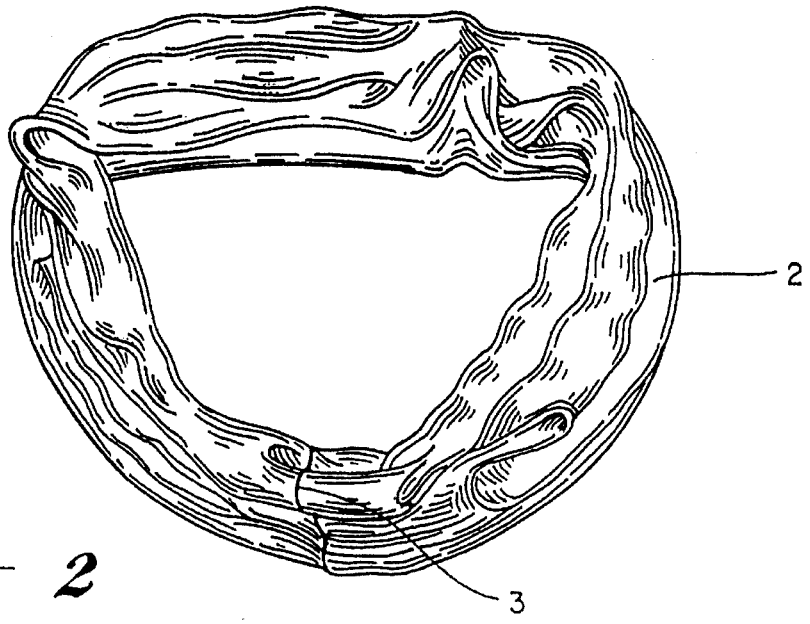
FIG. 2 is a perspective view of my ring shaped scarf.

Referring now to the drawings, FIG. 1 illustrates my ring shaped scarf 2 and clip 4 combination as can be worn on a woman in accordance with my invention. The ring shaped scarf 2 (FIG. 1) is made of a suitable piece of scarf material, such as silk or polyester, that is used in making fashionable scarves for women. The ring shaped scarf 2 is made from a piece of scarf material having two ends. The ring shaped scarf 2 is formed by attaching the ends to each other by stitching the ends together using thread 3 thereby forming a ring shaped piece of scarf material with a central opening having a sufficient length and diameter to fit over a woman's head and around a woman's neck.

Figure 3:
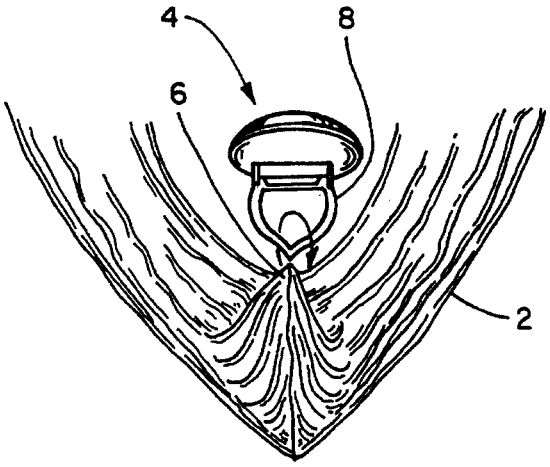
FIG. 3 is a fragmentary view illustrating the first step in the way in which a fashionable bow is created on the lower end of the scarf using the ring shaped scarf and the clip.
Figure 4:
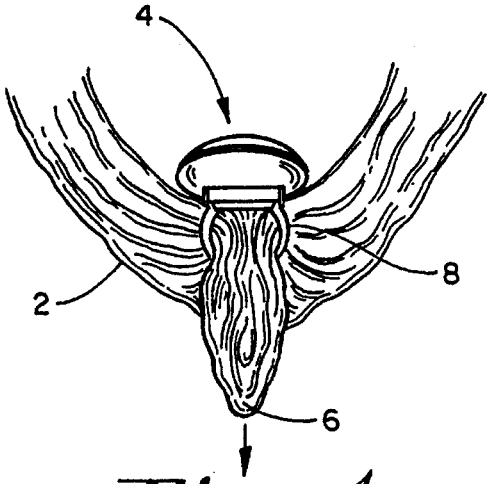
FIG. 4 is a fragmentary view illustrating the second step in the way in which a fashionable bow is created on the lower end of the scarf using the ring shaped scarf and the clip.
Figure 5:
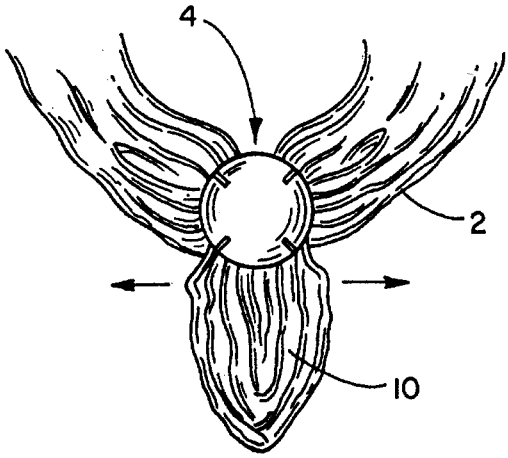
FIG. 5 is a fragmentary view illustrating the third step in the way in which a fashionable bow is created on the lower end of the scarf using the ring shaped scarf and the clip.
Figure 6:
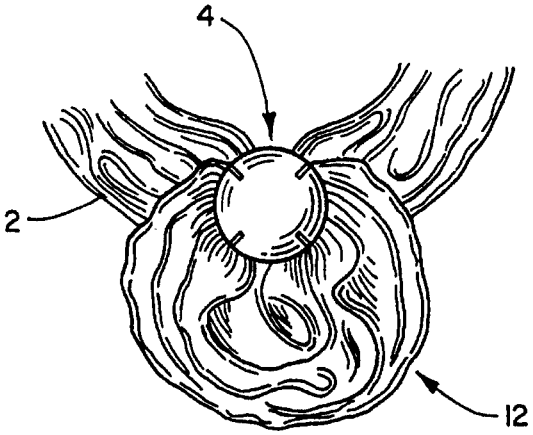
FIG. 6 is a fragmentary view illustrating a fashionable bow that is on the lower end of the scarf using the ring shaped scarf and the clip.

FIGS. 3–6 illustrate a method of creating a fashionable shape with my ring shaped scarf 2 and ornamental clip 4. As the scarf 2 is around the woman's head, a lower edge portion 6 (FIG. 3) of the scarf is pulled through a ring portion 8 of the open ornamental clip 4 as illustrated by the arrow (FIG. 3). The edge portion 6 (FIG. 4) of the scarf is then pulled downwardly thereby pulling more scarf material through the ring portion 8 of the open ornamental clip 4. The ornamental clip 4 is then pushed down thereby closing the ornamental clip and pinching the scarf material that has passed through the ring portion 8. The scarf material 10 that has passed through the ring portion 8 is to be spread outwardly (FIG. 5) as indicated by the arrows. As the scarf material 10 is being spread outwardly, more scarf material may still pass through the ring portion 8 of the ornamental clip 4 in order to create a flowerlike shape 12 (FIG. 6).

Figure 7:
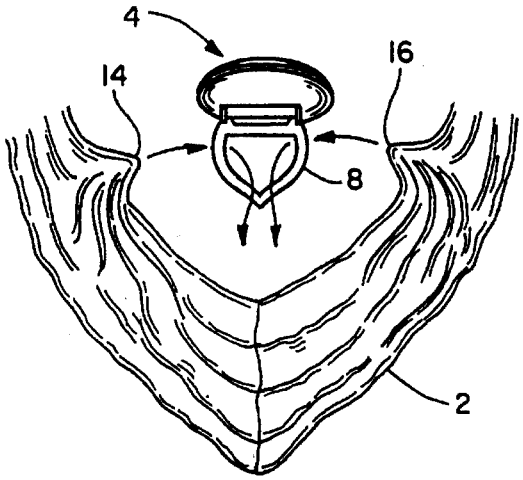
FIG. 7 is a fragmentary view illustrating the first step in the way in which a fashionable bow is created on the central part of the scarf using the ring shaped scarf and the clip.
Figure 8:
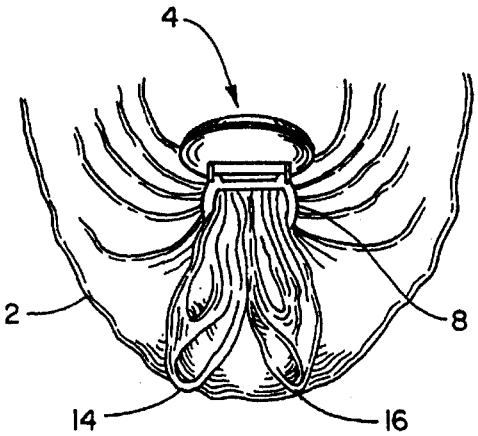
FIG. 8 is a fragmentary view illustrating the second step in the way in which a fashionable bow is created on the central part of the scarf using the ring shaped scarf and the clip.
Figure 9:
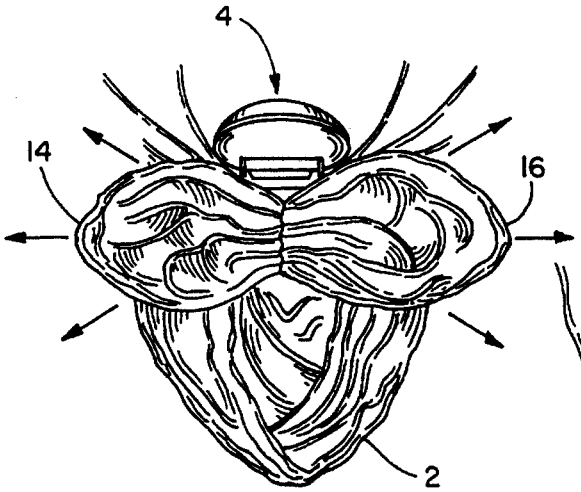
FIG. 9 is a fragmentary view illustrating the third step in the way in which a fashionable bow is created on the central of the scarf using the ring shaped scarf and the clip.
Figure 10:
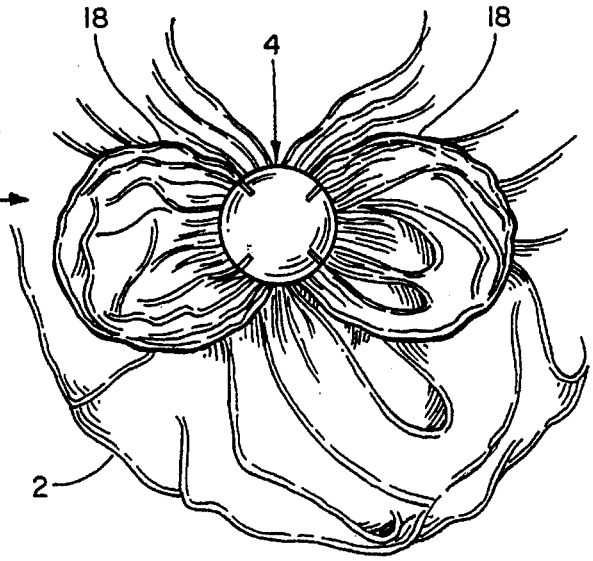
FIG. 10 is a fragmentary view illustrating a fashionable bow that is on the central part of the scarf using the ring shaped scarf and the clip.

FIGS. 7–10 illustrate another method of creating a fashionable shape with my ring shaped scarf 2 and ornamental clip 4. As the scarf 2 is around the woman's head, centrally located scarf edge portions 14, 16 (FIG. 7) are pulled through the ring portion 8 of the open ornamental clip 4 as illustrated by the arrows (FIG. 7). Scarf edges 14, 16 (FIG. 8) are pulled sufficiently enough to have an appropriate amount of scarf material to create a bow. The centrally located scarf edge portions 14, 16 (FIG. 9) are then pulled away from each other and spread apart as indicated by the arrows (FIG. 9). The open ornamental clip 4 is then closed thereby creating a bow 18 (FIG. 10).

Figure 11:
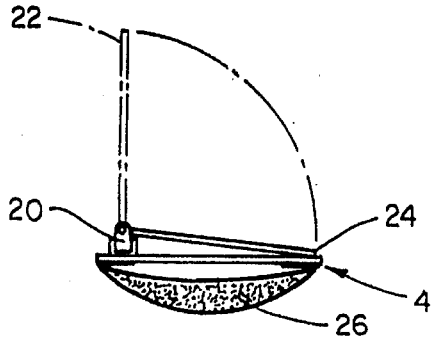
FIG. 11 is a side view of my clip illustrating the open and closed positions of the clip.
Figure 12:
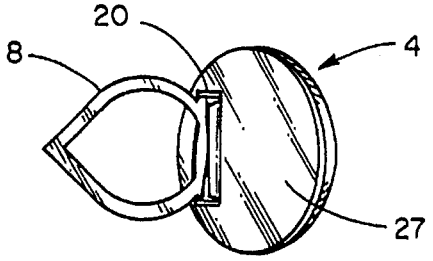
FIG. 12 is a perspective view of the back side of my clip shown in an open position.

FIGS. 11 and 12 illustrate my ornamental clip 4. My ornamental clip 4 can be relatively moved on its hinge 20 from an open position 22 to a closed position 24. The ornamental clip 4 is attached to an ornamental portion 26 that is made to match with the ring shaped scarf. The ornamental clip 4 has a ring portion 8 that can be used to put scarf material through when the clip is in an open position 22 and can then be closed 24 while the scarf material is in the ring portion 8 thereby pinching the scarf material and holding it in place. The ring portion 8 is made of metal and engages a metal backing 27 when the ring portion 8 is in a closed position.

Figure 13:
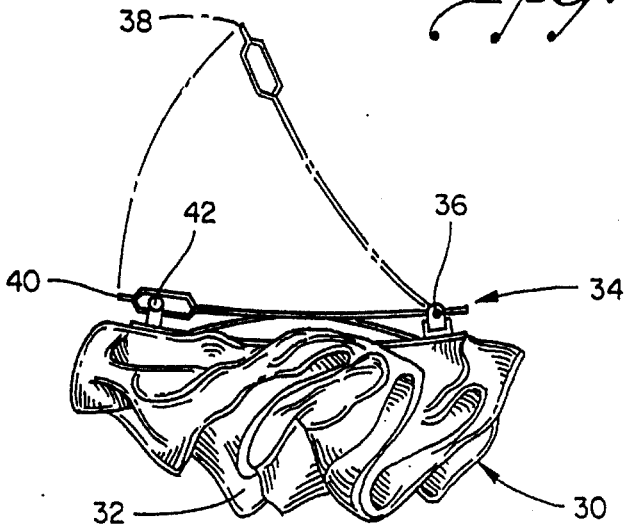
FIG. 13 is a side view of my bow clasp illustrating the open and closed positions of the bow clasp.

FIG. 13 illustrates a bow 30 that can also be used in combination with my ring shaped scarf. The bow 30 has an ornamental bow portion 32 that is attached to a clasp 34. The clasp 34 is like any ordinary clasp that is used with similar types of hair bows. The clasp 34 can be relatively moved on its hinge 36 from an open position 38 to a closed position 40 and is held in closed position by a pin 42. The bow 30 is used to pinch scarf material in between the hinge 36 and the pin 42 thereby allowing one to hold the scarf material in a specific location and creating a fashionable appearance.

Figure 14:
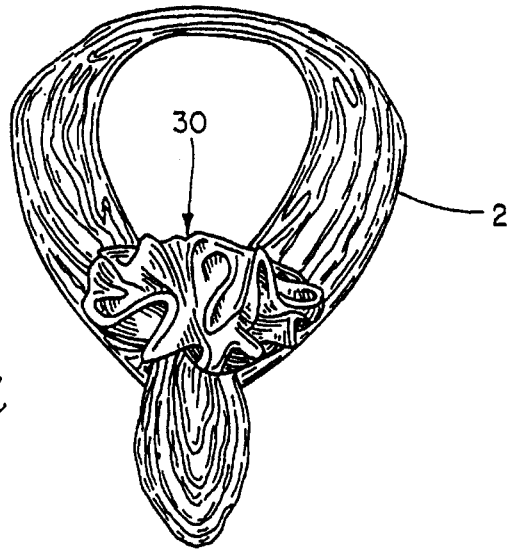
FIG. 14 is a perspective view of one of the many fashionable ways my ring shaped scarf and bow clasps can be worn together.
Figure 15:
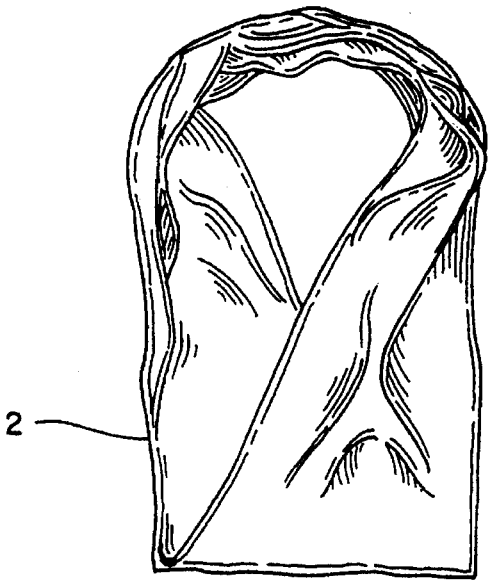
FIG. 15 is a perspective view of a fashionable way of wearing just my ring shaped scarf.
Figure 16:
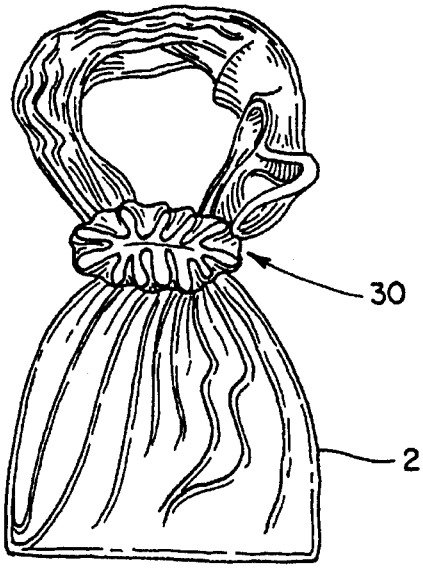
FIG. 16 is a perspective view of another fashionable way of wearing my ring shaped scarf and bow clasp.

FIGS. 14–17 show a fashionable arrangement that can be made with my ring shaped scarf 2. FIG. 14 illustrates the fashionable combination of my ring shaped scarf 2 and bow 30. FIGS. 15 and 16 illustrate another method of creating a different fashionable combination of my ring shaped scarf 2 and bow 30. As the ring shaped scarf 2 is placed on the woman's head, the edges of the scarf are spread out as shown in FIG. 15, then central locations of the ring shaped scarf are pinched by the bow 30 thereby creating the fashionable ring shaped scarf and bow combination in FIG. 16.

Figure 17:
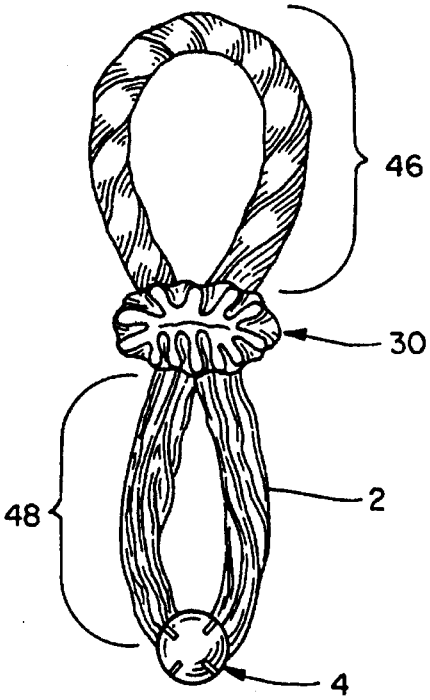
FIG. 17 is a perspective view of one of the many fashionable ways my ring shaped scarf, clip and bow clasps can be worn together.

FIG. 17 illustrates how my ring shaped scarf 2 can be used with the ornamental clip 4 and the bow 30. After the ring shaped scarf 2 is placed on the woman's head, the ring shaped scarf 2 is then twisted thereby creating a twisted look 46. The bow 30 is then clasped onto a central portion of the ring shaped scarf 2. The lower portion of the ring shaped scarf 2 can then be untwisted 48 and the ornamental clip 4 can be placed over the ring shaped scarf 2 at the bottom end of the ring shaped scarf 2 whereby a fashionable ring shaped scarf, clip and bow combination is created.

As various possible embodiments may be made in the above invention for use for different purposes and as various changes might be made in the embodiments and method above set fort, it is understood that all of the above matters here set forth or shown in the accompanying drawings are to be interpreted as illustrative and not in a limiting sense.

I claim:

1. In a method of creating a fashionable scarf and a clip ensemble, the clip being of the type having a ring shaped clip portion that is hingedly connected to an ornamental clip portion, with the hinge and ornamental clip portions being relatively movable from closed to open positions, the steps of forming a length of scarf material into a loop, said scarf material having two ends, attaching the ends to each other to form a ring shaped piece of scarf material with a central opening having a sufficient length and diameter to fit over a woman's head and around a woman's neck and then pinching areas of the ring shaped piece of scarf material together with the clip thereby creating a fashionable scarf and clip ensemble, wherein the fashionable scarf and clip ensemble also includes the steps of grasping centrally located inner edges of the ring shaped piece of scarf material and then projecting them through the ring shaped clip portion when the clip is in an open position and pulling the inner edges of the ring shaped piece of scarf material through the ring shaped clip portion and then turning the inner edge portions so as to extend them in opposite directions relative to one another to enlarge the breadth of the scarf thereby creating a flowerlike shape, and then moving the ornamental clip portion on its hinge towards the ring shaped clip portion and against the scarf to clamp and hold the edge portions securely against the ring shaped piece of scarf material, whereby a flowerlike shape is centrally located on the ring shaped piece of scarf material.

2. In a method of creating a fashionable scarf and a clip ensemble, the clip being of the type having a ring shaped clip portion that is hingedly connected to an ornamental clip portion, with the hinge and ornamental clip portions being relatively movable from closed to open positions, the steps of forming a length of scarf material into a loop, said scarf material having two ends, attaching the ends to each other to form a ring shaped piece of scarf material with a central opening having a sufficient length and diameter to fit over a woman's head and around a woman's neck and then pinching areas of the ring shaped piece of scarf material together with the clip thereby creating a fashionable scarf and clip ensemble, wherein the fashionable scarf and clip ensemble also includes the steps of grasping inner edges located towards the bottom of the ring shaped piece of scarf material and then projecting them through the ring shaped clip portion when the clip is in an open position and pulling the inner edges of the ring shaped piece of scarf material through the ring shaped clip portion and then pulling the scarf material downwardly away from the hinged area of the clip thereby creating a bow and then moving the ornamental clip portion on its hinge towards the ring shaped clip portion and against the scarf to clamp and hold the edge portions securely against the ring shaped piece of scarf material, whereby the bow is located below the ring shaped piece of scarf material.

3. In a method of creating a fashionable scarf and a clip ensemble, the clip being of the type having a ring shaped clip portion that is hingedly connected to an ornamental clip portion, with the hinge and ornamental clip portions being relatively movable from closed to open positions, the steps of forming a length of scarf material into a loop, said scarf material having two ends, attaching the ends to each other to form a ring shaped piece of scarf material with a central opening having a sufficient length and diameter to fit over a woman's head and around a woman's neck and then pinching areas of the ring shaped piece of scarf material together with the clip thereby creating a fashionable scarf and clip ensemble, wherein the fashionable scarf and clip ensemble also includes a bow, the bow being of the type having a bow clasp portion that is hingedly connected to an ornamental bow portion, with the bow clasp portions and ornamental bow portions being relatively movable from closed to open positions, said fashionable scarf and clip ensemble also includes the steps of grasping a bottom portion of the ring shaped piece of scarf material and then twisting the scarf material until the ring shaped piece of scarf material is fully twisted and then clasping the bow about the scarf material at a center portion of the scarf thereby securing the scarf material that is positioned around the neck in a twisted look, then untwisting the scarf material below the bow and placing the open clip over the untwisted scarf material at the bottom of the scarf and closing the clip about the untwisted scarf material thereby creating a fashionable scarf, bow and clip ensemble.

4. In a method of attaching a fashionable scarf and a clip ensemble to the neck of the wearer, the clip being of the type having a ring shaped clip portion that is hingedly connected to an ornamental clip portion, with the hinge and ornamental clip portions being relatively movable from closed to open positions, the steps of forming a length of scarf material into a loop, said scarf material having two ends, attaching the ends to each other to form a ring shaped piece of scarf material with a central opening having a sufficient length add diameter to fit over a woman's head and around a woman's neck and then pinching areas of the ring shaped piece of scarf material together with the clip thereby creating a fashionable scarf and clip ensemble, wherein the fashionable scarf and clip ensemble also includes the steps of grasping centrally located inner edges of the ring shaped piece of scarf material and then projecting them through the ring shaped clip portion when the clip is in an open position and pulling the inner edges of the ring shaped piece of scarf material through the ring shaped clip portion and then turning the inner edge portions so as to extend them in opposite directions relative to one another to enlarge the breadth of the scarf thereby creating a flowerlike shape, and then moving the ornamental clip portion on its hinge towards the ring shaped clip portion and against the scarf to clamp and hold the edge portions securely against the ring shaped piece of scarf material, whereby a flowerlike shape is centrally located on the ring shaped piece of scarf material.

5. In a method of creating a fashionable scarf and a clip ensemble, the scarf being a ring shaped piece of scarf material with a central opening having a sufficient length and diameter to fit over a woman's head and around a woman's neck, the clip being of the type having a ring shaped clip portion that is hingedly connected to an ornamental clip portion, with the hinge and ornamental clip portions being relatively movable from closed to open positions and then pinching areas of the ring shaped piece of scarf material together with the clip thereby creating a fashionable scarf and clip ensemble, wherein the fashionable scarf and clip ensemble also includes the steps of grasping inner edges located towards the bottom of the ring shaped piece of scarf material and then projecting them through the ring shaped clip portion when the clip is in an open position and pulling the inner edges of the ring shaped piece of scarf material through the ring shaped clip portion and then pulling the scarf material downwardly away from the hinged area of the clip thereby creating a bow and then moving the ornamental clip portion on its hinge towards the ring shaped clip portion and against the scarf to clamp and hold the edge portions securely against the ring shaped piece of scarf material, whereby the bow is located below the ring shaped piece of scarf material.

6. In a method of creating a fashionable scarf and a clip ensemble, the scarf being a ring shaped piece of scarf material with a central opening having a sufficient length and diameter to fit over a woman's head and around a woman's neck, the clip being of the type having a ring shaped clip portion that is hingedly connected to an ornamental clip portion, with the hinge and ornamental clip portions being relatively movable from closed to open positions and then pinching areas of the ring shaped piece of scarf material together with the clip thereby creating a fashionable scarf and clip ensemble, wherein the fashionable scarf and clip ensemble also includes a bow, the bow being of the type having a bow clasp portion that is hingedly connected to an ornamental bow portion, with the bow clasp portions and ornamental bow portions being relatively movable from closed to open positions, said fashionable scarf and clip ensemble also includes the steps of grasping a bottom portion of the ring shaped piece of scarf material and then twisting the scarf material until the ring shaped piece of scarf material is fully twisted and then clasping the bow about the scarf material at a center portion of the scarf thereby securing the scarf material that is positioned around the neck in a twisted look, then untwisting the scarf material below the bow and placing the open clip over the untwisted scarf material at the bottom of the scarf and closing the clip about the untwisted scarf material thereby creating a fashionable scarf, bow and clip ensemble.

7. In combination a fashionable scarf and a clip ensemble, the clip being of the type having a ring shaped clip portion that is hingedly connected to an ornamental clip portion, with the hinge and ornamental clip portions being relatively movable from closed to open positions, the ring shaped scarf comprising a loop and having two ends, stitches joining the scarf ends to each other providing a ring shaped scarf piece with a central opening having a sufficient diameter to fit over a woman's head and around a woman's neck, and the clip being attached to the ring shaped scarf for location in adjacency to a person's chin in a fashionable scarf and clip ensemble, the scarf having centrally located inner edges of the ring shaped piece of scarf material extended through the ring shaped clip portion when the clip is in an open position, the inner edges of the ring shaped piece of scarf material being positioned so that the edges are extended in directions diametrically opposed to one another creating a flowerlike shape, the ornamental clip portion being movable on its hinge towards the ring shaped clip portion and against the scarf to securely hold the scarf against movement to maintain the adjusted flowerlike shape.

8. In combination a fashionable scarf and a clip ensemble, the clip being of the type having a ring shaped clip portion that is hingedly connected to an ornamental clip portion, with the hinge and ornamental clip portions being relatively movable from closed to open positions, the ring shaped scarf comprising a loop and having two ends, stitches joining the scarf ends to each other providing a ring shaped scarf piece with a central opening having a sufficient diameter to fit over a woman's head and around a woman's neck, and the clip being attached to the ring shaped scarf for location in adjacency to a person's chin in a fashionable scarf and clip ensemble, the scarf having a bottom inner edge of the ring shaped piece of scarf material extended through the ring shaped clip portion when the clip is in an open position, the bottom inner edge of the ring shaped piece of scarf material being positioned so that the edges are extended in a downwardly and outwardly direction creating a flowerlike shape, the ornamental clip portion being movable on its hinge towards the ring shaped clip portion and against the scarf to securely hold the scarf against movement to maintain the adjusted flowerlike shape.

* * * * *